166-66 SR

1/11/83 XR 4,367,797

United States Patent [19]

Brown

[11] 4,367,797

[45] Jan. 11, 1983

[54] CABLE TRANSFER SUB FOR DRILL PIPE AND METHOD

[75] Inventor: Robert L. Brown, Buena Park, Calif.

[73] Assignee: AMF Incorporated, White Plains, N.Y.

[21] Appl. No.: 180,808

[22] Filed: Aug. 25, 1980

[51] Int. Cl.[3] ..... E21B 47/00

[52] U.S. Cl. ..... 166/380; 166/66; 174/47; 339/94 R

[58] Field of Search ..... 166/315, 65 R, 378–380; 339/94 R, 103 C, 103 R, 103 M; 285/175, 355, 390, 132; 277/102, 110; 340/18; 174/47; 175/40, 45, 50

[56] References Cited

U.S. PATENT DOCUMENTS

| | | | |
|---|---|---|---|
| 2,232,360 | 2/1941 | Barnett | 174/47 |
| 2,690,713 | 10/1954 | Urmann et al. | 166/65 R |
| 3,170,137 | 2/1965 | Brandt | 340/18 |
| 3,181,629 | 5/1965 | Birman | 175/40 |
| 3,196,948 | 7/1965 | Dye | 166/65 |
| 3,253,245 | 5/1966 | Brandt | 339/16 |
| 3,322,196 | 5/1967 | Bodine, Jr. | 166/65 R |
| 3,342,267 | 9/1967 | Cotter et al. | 166/65 R |
| 3,372,762 | 3/1968 | Cullen et al. | 175/320 |
| 3,731,742 | 5/1973 | Sizer et al. | 166/65 M |
| 4,062,551 | 12/1977 | Base | 277/102 |

*Primary Examiner*—Ernest R. Purser
*Attorney, Agent, or Firm*—William P. Green

[57] ABSTRACT

A sub for connection into a drill string which has a cable extending along the outside of the string to the location of the sub and then extending downwardly within the string beyond the sub. The sub includes two members which are connectable to upper and lower portions of the drill string and are detachably connectable to one another, preferably by a surrounding threaded sleeve, with the cable extending between the two members in sealed relation from the exterior of the first member to the interior of the second.

30 Claims, 7 Drawing Figures

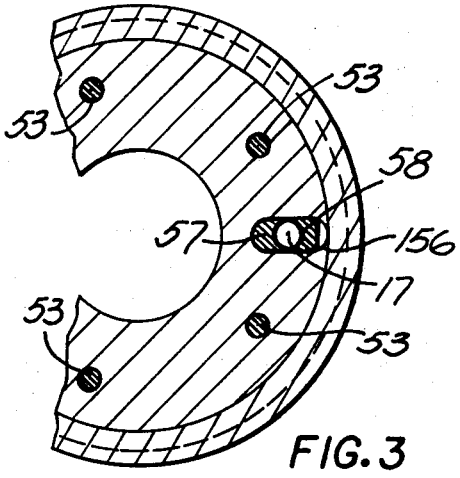
FIG. 3
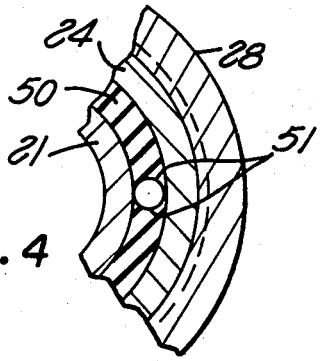
FIG. 4
FIG. 6
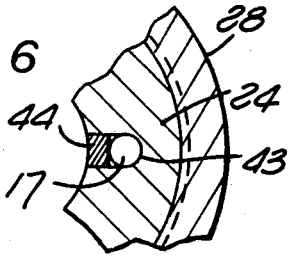
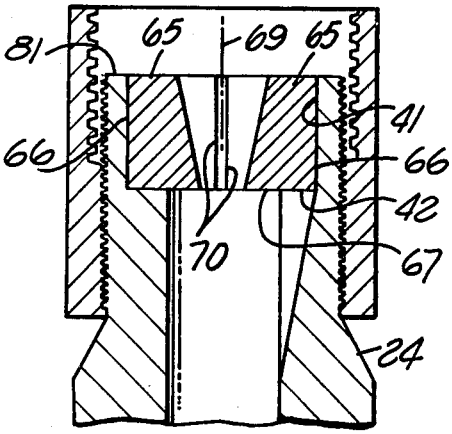
FIG. 7
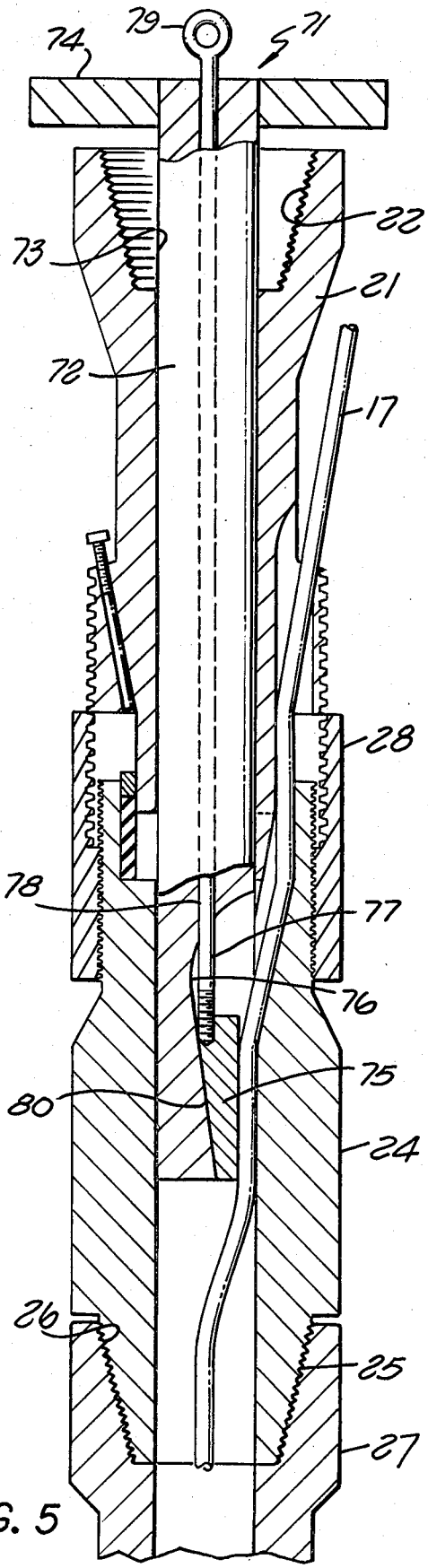
FIG. 5

CABLE TRANSFER SUB FOR DRILL PIPE AND METHOD

BACKGROUND OF THE INVENTION

This invention relates to improved units adapted to be connected into a well drilling string and constructed to pass a cable from the exterior of the string to its interior at the location of the unit.

During the drilling of a well, it is frequently desirable to utilize an instrument or other equipment carried by a lower portion of the drill string and connected to the surface of the earth by an electrical cable. For example, the drill string may contain a 'steering tool' probe adapted to sense the inclination of the lower portion of the drill string and the direction of that inclination and convey the sensed information to the surface of the earth through a cable to indicate to the driller the amount and direction of inclination so that he may introduce such corrections into the direction in which the drilling operation is progressing to ultimately arrive at a desired location in the earth. In other instances, a drilling motor for driving the bit may be energized or controlled through a cable.

If the cable of such a steering tool or other instrument or piece of equipment carried within or by the lower portion of a drill string extends upwardly through the interior of the string to the surface of the earth, a problem arises in connecting additional pipe sections to the upper end of the string without encountering interference as a result of the presence of the cable in the string. Unless other provision is made for avoiding this difficulty, it may be necessary to withdraw the entire cable and instrument assembly upwardly from the string each time that a section of pipe is added, and then relower the cable and instrument into the string after the section has been added. Such a procedure is extremely time consuming and expensive of rig time and labor and adds considerably to the overall cost of drilling a well.

One expedient for attempting to overcome this difficulty is disclosed in U.S. Pat. No. 4,062,551 issued Dec. 13, 1977 to Base on "Cable Seal Unit for Earth-Boring Drill Strings", which shows a tubular part adapted to be connected into the drill string at a location spaced beneath the surface of the earth and containing an inclined passageway extending through a side wall of the tubular part to pass an electrical cable through that passageway from the exterior to the interior of the part. The cable extends downwardly along the outside of the drill string to the location of this part or sub, and at that location extends through the wall of the sub to its interior to then pass downwardly within the lower portion of the drill string to the associated instrument, probe, or the like. Because the upper portion of the cable is located at the outside of the drill string, sections can be added to or removed from the upper end of the drill string without removing the cable and instrument or encountering interference by virtue of the presence of the cable. The patent contemplates sealing the wall passage through which the cable extends, and attaching a clamp to the outside of the wall of the sub part to secure the cable in place.

A difficulty which is inherent in use of a sub of the type shown in U.S. Pat. No. 4,062,551 resides in the inconvenience involved in threading the cable through the passage in the side wall of the sub. Besides that inconvenience, both the cable and the sub may be subjected to substantial wear as the cable is threaded through the side wall passage, with a resultant reduction in the effective useful life of the parts and possible early development of interruptions in the electrical insulation on the cable.

SUMMARY OF THE INVENTION

The present invention provides an improved cable transfer sub for passing a cable from the exterior to the interior of a drill string in order to achieve the above discussed general purpose, but in a manner greatly facilitating use of the sub as compared with the device shown and described in U.S. Pat. No. 4,062,551. The sub of the present invention consists of an assembly of parts so constructed and related as to avoid the necessity for laboriously threading a cable through an opening in the side wall of a part of the type shown in that prior patent, and also avoiding the wear and deterioration of insulation resulting from such an arrangement. In a system embodying the present invention, an instrument or other unit or tool can be connected to a suspending cable at the surface of the earth, and can be lowered directly downwardly into the drill string as rapidly as if no cable transfer sub were to be utilized. After the instrument and cable have been lowered into the string, the parts of the transfer sub can be assembled easily and quickly to form a composite unit in which the cable extends between the exterior and interior of the string in sealed and suspended relation.

To achieve these results, the transfer sub includes two members which are adapted to be threadedly connected to upper and lower portions of the drill string respectively, and which are connectable together in a relation passing the cable from the exterior to the interior of the string between opposed portions of the two members. The members are desirably secured together detachably by threaded connector means, preferably taking the form of a sleeve disposed about the two members and having threads engaging the two members in a manner pulling the members relatively axially toward one another in response to rotation of the sleeve. For this purpose, the sleeve may have threads of two different pitches engaging the two members to attain the desired relative axial movement of the members in response to rotation of the outer sleeve.

The cable may extend generally axially between radially opposed surfaces of the two members, preferably formed on a tubular projection of one member extending into and interfitting with a tubular portion of the other member. Sealing means are provided for preventing fluid flow between the exterior and interior of the assembly, typically including a packing ring received radially between the two members and forming a seal with both members and the cable. A clamping structure may act to grip the cable in a manner preventing its longitudinal movement when the connection is made up, with this clamping structure desirably being located between the threaded connector sleeve and one of the members. During assembly of the sub structure, an aligning mandrel may be positioned in the two principal tubular members of the device to hold them in alignment, and may carry means for gripping the cable and holding it in position as the threaded connection is made up.

BRIEF DESCRIPTION OF THE DRAWINGS

The above and other features and objects of the invention will be better understood from the following detailed description of the typical embodiment illustrated in the accompanying drawings, in which:

FIGS. 3 and 4 are fragmentary horizontal sections taken on lines 3—3 and 4—4 respectively of FIG. 2;

FIG. 5 is a vertical sectional view similar to FIG. 2, but showing the parts of the transfer sub before rotation of the connector sleeve to secure the members together, and with the aligning and cable holding mandrel in use;

FIG. 6 is a fragmentary horizontal section on line 6—6 of FIG. 2; and

FIG. 7 is a view showing protective inserts which may be utilized during lowering of a cable and instrument into the drill string or during upward withdrawal of the cable and instrument therefrom.

DESCRIPTION OF THE PREFERRED EMBODIMENT

The invention has been illustrated and will be described primarily as applied to a generally vertical well, with reference for convenience to upper and lower portions of the well, drill string, cable, etc. It will be understood, however, that the invention may also be applied to horizontal wells or bores, such as are utilized in mining operations for example, or wells or bores drilled at any inclination between vertical and horizontal.

Figure 1:
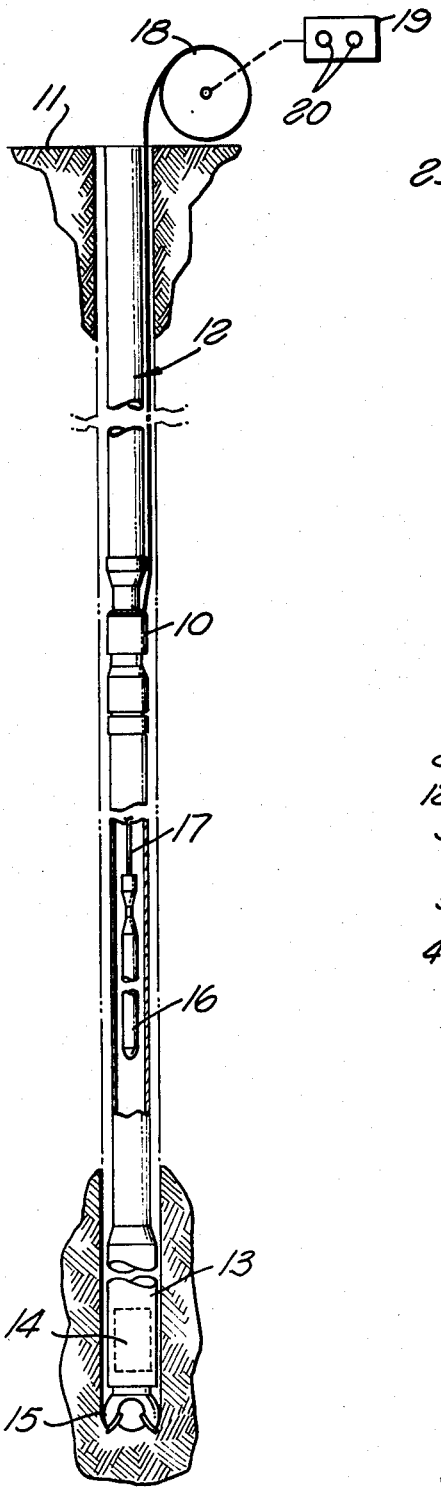
FIG. 1 is a somewhat diagrammatic representation of a well containing a drill string having a cable transfer sub constructed in accordance with the invention.

The apparatus illustrated in FIG. 1 includes a cable transfer sub 10 connected into a drill string 12 being utilized to drill a well bore downwardly from the surface 11 of the earth. The drill string is formed in conventional manner of a large number of pipe sections connected threadedly together in end to end fashion and carrying a drilling unit 13 at the lower end of the string. The drilling unit 13 may be of a type which does not require rotation of the string in order to attain a drilling effect, and for that purpose may contain a motor 14 acting to rotate bit 15 relative to the non-rotating body of drilling unit 13. The motor may be powered in conventional manner by the pressure of drilling fluid pumped downwardly through the interior of the drill string, or may be an electric motor powered by current delivered to it from the surface of the earth. An instrument 16 is contained within the string near the drilling unit 13, and is connected to and suspendable by a cable 17 extending upwardly through the well and typically wound about a reel 18 at the surface of the earth and connected electrically to a readout unit 19 having dials or other indicating elements 20 visible to a driller. The instrument 16 may be located within the drill string by a mule shoe connector carried by the string, or may be located by any other appropriate means, and may typically be a steering tool probe adapted to sense the inclination of the lower portion of the drill string, and the direction of that inclination, and deliver signals upwardly through cable 17 to readout unit 19 in multiplexed fashion for informing the driller by dials 20 or other indications of the direction in which the drilling is progressing. Cable 17 may function as a single conductor, preferably formed of a number of braided copper wires, all enclosed within an outer layer of electrical insulation. The second side of the electrical circuit between the instrument probe 16 and readout unit 19 may be completed through the drill pipe or ground, or through an armor covering on the insulation.

In extending downwardly from the surface of the earth, cable 17 is received at the outside of the drill string from the surface to the location of transfer sub 10, and at that sub extends inwardly to the interior of the string to then extend downwardly through the lower portion of the string to instrument 16. The manner in which the cable extends from the exterior to the interior of the string is illustrated best in FIG. 2. As seen in that figure, the transfer sub assembly 10 includes an upper first tubular member 21 containing tapering internal threads 22 into which the externally threaded pin end 23 of a section of the upper portion of the drill string is threadedly connectable. Beneath the member 21, the assembly 10 includes a second tubular member 24 having a lower externally threaded pin end 25 connectable into an internally threaded box end 26 of an upper section 27 of the lower portion of the drill string. In addition to the parts 21 and 24, the sub 10 includes a connector sleeve 28 which threadedly engages both of the members 21 and 24 to tighten them together.

The lower end of member 21 has an external screw thread 29 of uniform diameter and relatively coarse pitch, say for example three threads per inch, formed on a preferably slightly enlarged portion 30 of member 21 and centered about axis 33 of the sub and drill string. Sleeve 28 has an upper set of internal threads 31 of the same coarse pitch engaging threads 29. At the lower end of threads 29, member 21 has a substantially annular shoulder 32 disposed perpendicular to axis 33. Projecting downwardly beyond this shoulder 32, member 21 has a tubular lower portion 34 with an outer cylindrical surface 35 centered about axis 33. Internally, part 21 contains a cylindrical inner surface 36 forming a straight cylindrical bore extending entirely through part 21 except at the location of its upper threads 22.

The lower portion 34 of member 21 projects downwardly into a counterbore or annular recess 37 formed in an upper tubular portion 38 of the lower part 24. Externally, portion 38 of part 24 has a screw thread 39, of uniform diameter and of a more rapid pitch than the previously mentioned threads 29 and 31. For example, it threads 29 and 31 are of a pitch corresponding to three threads per inch, the more rapid pitch of threads 39 may be six threads per inch. The lower portion of sleeve 28 contains a second set of internal threads 40, corresponding to and mating with external threads 39 of part 24. Threads 39 and 40, like threads 29 and 31, are centered about axis 33 of the assembly 10, with the lower threads 39 and 40 preferably being of a diameter less than threads 29 and 31. Desirably, the minor diameter of internal thread 31 of the sleeve is at least as great as and preferably greater than the major diameter of thread 39 of member 24, in order to enable movement of the sleeve to the retracted position illustrated in FIG. 5 without interference being offered by engagement of threads 31 and 39.

Internally, the counterbore 37 in the upper portion of part 24 is defined by a cylindrical internal surface 41 centered about axis 33 and a transverse shoulder surface 42 at the lower end of the counterbore. Surface 42 is circularly continuous except at the location of a cable receiving groove and keyway 43 which is formed in member 24 beneath shoulder 42 and slidably receives a key 44 formed integrally with part 21 and projecting downwardly therefrom. The sliding reception of key 44 in groove 43 retains members 21 and 24 against relative rotation, while permitting their relative axial movement. Key 44 and keyway 43 may progressively increase in radial dimension as they advance upwardly to have the triangular axial sectional configuration illustrated in FIG. 2. The radial spacing between inclined outer wall 143 of the keyway and correspondingly inclined outer surface 144 of the key is just great enough to receive cable 17 therebetween in closely confined relation.

Beneath threads 39, part 24 may have an externally enlarged diameter portion 46 engageable with tongs or another tool for turning part 24. The inner surface 47 of part 24 is preferably of straight cylindrical configuration aligned with and forming a continuation of the straight cylindrical surface 36 within upper part 21.

Figure 2:
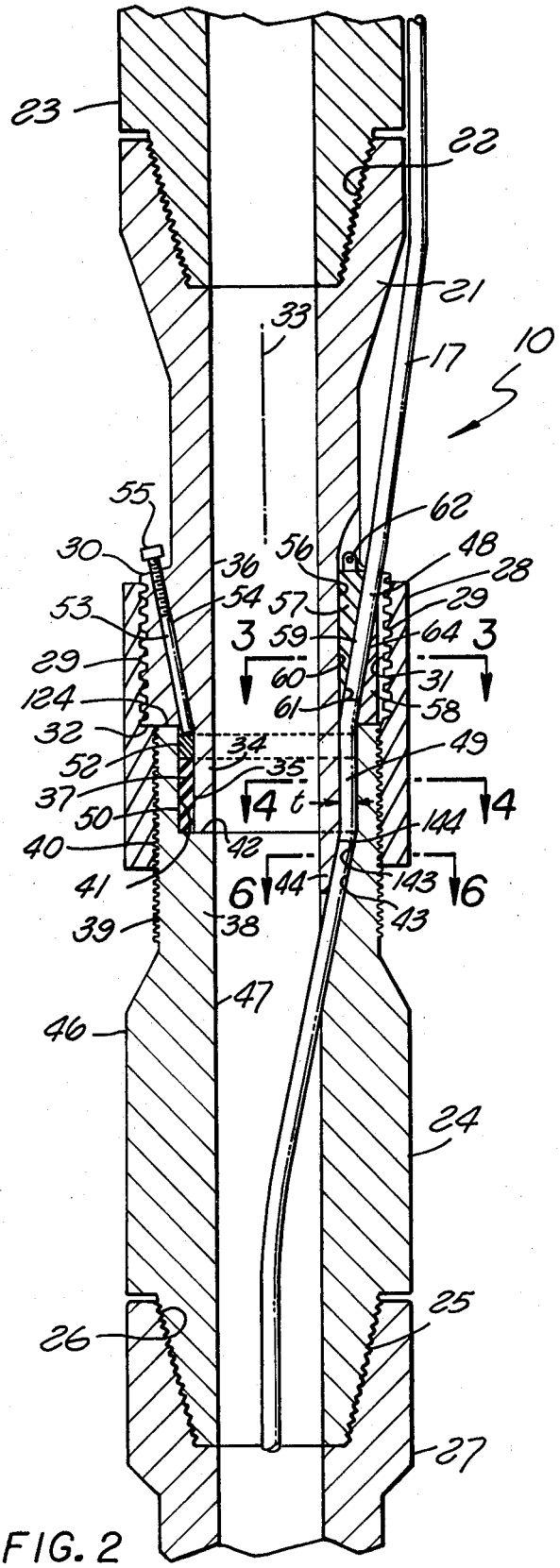
FIG. 2 is an enlarged fragmentary vertical section through the sub unit of the present invention.

Cable 17 is received at the outside of the upper member 21 of sub 10, and extends downwardly and inwardly at 48 radially between part 21 and sleeve 28, then downwardly at 49 radially between lower portion 34 of part 21 and the upper portion of part 24, and then downwardly and inwardly within keyway groove 43 in the interior of part 24, from which the cable advances downwardly within part 24 and the lower portion of the drill string to instrument 16. The external diameter of cable 17 corresponds to or is slightly greater than the radial spacing t between surfaces 35 and 41, to simultaneously engage both of those surfaces as seen in FIG. 2. Within the space between surfaces 35 and 41, there is provided a seal ring 50 formed of an appropriate deformable packing material such as neoprene, formulated to withstand the temperatures, pressures and fluids or chemicals encountered in the well. Ring 50 is annular except at the location of cable 17, at which the end surfaces 51 of the ring are curved semi-cylindrically as seen in FIG. 4 to engage cable 17 circularly continuously except at its points of contact with surfaces 35 and 41. When seal ring 50 is pressed downwardly by a rigid pressure ring 52 engaging its upper surface, the seal ring engages surfaces 35 and 41 and the cable in a manner positively preventing flow of any well fluid or drilling fluid between the exterior and interior of the string through the annular space between surfaces 35 and 41. Pressure ring 52 may be bonded to ring 50 for handling therewith, and like ring 50 is circularly continuous except at the location of cable 17, and may typically be formed of steel.

In order to apply a downward force on ring 52, there are provided a number of circularly spaced pressure screws 53, which may extend angularly downwardly and inwardly within threaded bores 54 in part 21 as seen in FIG. 2, so that when these screws are turned by a tool engaging their upper enlarged heads 55 the lower ends of the screws press downwardly against ring 52 to complete the seal.

To pass cable 17 downwardly at the location 48 radially between part 21 and sleeve 28, the outer surface of part 21 is cut away to form an axially extending groove 56, which is deep enough radially to allow reception of cable 17 entirely within the minor diameter of threads 31 of sleeve 28. In extending downwardly within this groove 56, the cable advances progressively radially inwardly at an inclination toward axis 33 and radially between inner and outer clamping elements 57 and 58 (FIGS. 2 and 3). Element 57 is shaped generally as a slip, confined within groove 56 for only vertical movement relative thereto, and having a radially inner surface 59 which extends directly axially and engages a corresponding directly axial inner wall surface 60 of groove 56 to retain element 57 against radially inner movement. At its outer side, clamping element 57 has an inclined surface 61 which advances progressively inwardly as it advances downwardly and may be shaped semi-circularly as seen in FIG. 3 to engage cable 17 about one-half of its circular extent. An eye 62 may be provided at the upper end of element 57 for moving it into and out of clamping position.

The radially inner surface 64 of the second clamping element 58 is inclined downwardly and inwardly at the same angle as and opposite surface 61, and like surface 61 may be curved semi-cylindrically to engage cable 17 about one-half of its circular extent. Element 58 is retained against radially outward movement by engagement of the radially outer surface of element 58 with a pair of spaced flanges 156 formed by the material of member 21 at opposite sides of groove 56. Element 58 is retained against downward movement in the FIG. 2 assembled condition of the parts by engagement with the upper transverse end surface 81 of member 24. The spacing between flanges 156 is great enough to allow the cable to be forced radially inwardly into groove 56. During such insertion of the cable into the groove, the insulation on the cable 17 may deform sufficiently to reduce the effective thickness of the cable for passage between the flanges.

For use during initial lowering of an instrument and cable into the drill string, and during withdrawal of this cable and instrument from the string, a pair of complementary inserts 65 (FIG. 7) are provided for placement within the upper portion of part 24. These inserts are semi-circular in horizontal section, and are supported and fit closely within counterbore 37, are more particularly have outer semi-cylindrical surfaces 66 which are complementary and correspond in diameter with and fit closely within surface 41 of part 24, and bottom horizontal surfaces 67 engaging and supported on shoulder 42. The inner surfaces of inserts 65 may taper inwardly toward axis 33 as they advance downwardly. The two inserts 65 may meet in a vertical diametrical plane 69, having end faces 70 engaging in that plane.

In order to facilitate connection of the two members 21 and 24 together, an aligning and clamping mandrel such as that shown at 71 in FIG. 5 may be provided. This mandrel may include a vertically elongated body 72 having an outer cylindrical surface 73 which is a close fit within the inner surfaces 36 and 47 in parts 21 and 24 to simultaneously engage those surfaces in a manner aligning parts 21 and 24 as seen in FIG. 5. A crossbar or handle 74 may be rigidly connected to the upper end of body 72 to facilitate handling of the mandrel. A cable gripping member 75 may be provided within a recess 76 formed in a lower portion of mandrel body 72, and be connected to an elongated rod 77 guided within a central passage 78 in body 72 for only directly axial movement relative to the body. An eye 79 at the upper end of rod 77 is provided for engagement in moving the rod and member 75 upwardly and downwardly. The mandrel is of a length such that, when the mandrel is positioned in elements 21 and 24 in the condition illustrated in FIG. 5, the gripping member 75 is located to engage cable 17 beneath counterbore 37 and keyway 43, and to clamp the cable radially outwardly against the inner surface of member 24. Elements 75 and 72 have engaging inclined camming surfaces at 80 which act to urge member 75 radially outwardly against the cable in clamping relation in response to downward movement of member 75 by actuation of rod 77.

To now describe a cycle of use of the illustrated apparatus, assume that the lower portion of the drill string of FIG. 1 has been advanced into the well to a point at which it is desired to connect transfer sub 10 into the string before the well is drilled any deeper. A first step in attaching sub 10 to the string is to connect its lower part or member 24 into the upper end of the drill string by completing the threaded connection represented at 25 and 26 in FIG. 2. This connection is made while upper part 21 is completely separated from part 24, and with sleeve 28 screwed to its lowermost position on part 24, as illustrated in FIG. 7. After the part 24 has been connected to the string as discussed, inserts 65 are placed in the upper end of part 24, and the instrument and cable may then be lowered into the string and through inserts 65. The inserts thus protect the surfaces within the upper portion of part 24 against direct contact with the instrument or cable, and maintain those surfaces and its contained groove 43 beneath the inserts against wear or damage. After the instrument has reached a desired location in the bottom of the string, and been located and anchored relative to the drilling unit 13, inserts 65 may be removed. The seal and pressure ring assembly 50–52 may then be inserted in counterbore 37, with its ends in engagement with the cable. The upper part 21 is then located as illustrated in FIG. 5, with the lowermost ends of its threads 29 just beginning to contact internal threads 31 at the top of the sleeve, and with mandrel 71 received within the parts to align them. The cable 17 and clamping element 58 are received within groove 60 in this FIG. 5 condition, and the second clamping element may also be in the groove, or alternatively element 57 may be left out of the groove at this point and be inserted into the groove in clamping position after threaded connection of the parts.

After the parts have been assembled to the condition illustrated in FIG. 5, rod 77 of the mandrel assembly 71 may be pressed downwardly to tightly clamp the cable against the inner surface of part 24 and thereby retain the cable in fixed position relative to the other parts while the threaded connection is made up. With the cable thus retained, sleeve 28 is rotated to advance it upwardly relative to part 24 from the FIG. 5 position to the FIG. 2 position. Both of the sets of threads 29–31 and 39–40 may be right-hand threads, so that rotation of sleeve 28 relative to parts 21 and 24 will act to advance the sleeve upwardly relative to both of these parts, but with the differential in pitch of the threads acting to simultaneously pull part 21 downwardly toward part 24 and ultimately to the fully seated position of FIG. 2 in which the lower end surface 32 of part 21 abuts against upper transverse end surface 81 of part 24. During actuation of parts 21 and 24 from their FIG. 5 position to their FIG. 2 position by rotation of sleeve 28, members 21 and 24 are retained against rotation relative to one another by reception of key 44 in keyway 43. After the parts have reached their FIG. 2 condition, clamping element 57 is inserted downwardly to its FIG. 2 position, and mandrel 71 may then be removed, after which screws 53 may be tightened to actuate pressure ring 52 downwardly against seal ring 50 in a manner pressing the seal ring tightly against surfaces 35 and 41 and the cable so that ring 50 and the cable form together a circularly continuous structure occupying the entire circular and radial extent of the space between surfaces 35 and 41 and forming an effective fluid-tight seal preventing the flow of any well liquid from the exterior of the sub assembly to its interior, and similarly preventing the escape of any circulating fluid under pressure from the interior of the sub to its exterior. The clamping element 57 acts in the manner of a slip to very positively prevent downward longitudinal movement of the cable, since any downward forces exerted on the cable tend to move element 57 downwardly in a relation clamping the cable more tightly between the opposed inclined faces of elements 57 and 58.

After the unit 10 has been made up as discussed, a next successive section of the drill pipe can be connected to the upper end of part 21, and the drilling unit 13 can be energized by pressure fluid within the drill string to turn bit 15 and continue the drilling operation. Thereafter, each time that it becomes necessary to add another section of pipe to the upper end of the drill string, this can be done without disconnecting the cable and without interference being offered by the cable, since the portion of the cable above unit 10 is entirely at the outside of the drill string. Similarly, a section or sections of the drill pipe can be removed from the upper end of the string if desired without disconnecting the cable or interrupting its connection to readout unit 19. As a result, readings can be taken by unit 19 at any desired time during the drilling operation.

When it becomes desirable to remove the cable and instrument from the well, part 21 can easily be detached from part 24 by merely advancing sleeve 28 downwardly on part 24 to the FIG. 5 position. The cable and instrument can then be withdrawn as freely and rapidly as if no transfer sub were employed. If during use of the sub it becomes desirable to adjust the cable longitudinally relative to the sub, this can be done by merely removing clamping element 57 upwardly from groove 60 to release the clamping action and enable longitudinal movement of the cable.

While a certain specific embodiment of the present invention has been disclosed as typical, the invention is of course not limited to this particular form, but rather is applicable broadly to all such variations as fall within the scope of the appended claims.

I claim:

1. A unit to be connected into a drill string which has a cable extending along the outside of the string to the location of said unit and then extending within the interior of the string beyond said unit, comprising:

a first tubular member adapted to be connected to a first tubular portion of the string;

a second tubular member adapted to be connected to a second tubular portion of the string; and means for detachably connecting said first and second members together;

said two members having opposed portions which are configured to pass said cable therebetween from the exterior of said first member to the interior of the second member when the members are secured together by said connecting means;

said opposed portions of said two members including tubular end portions of the two members one of which projects into the other and which are constructed to receive a portion of said cable radially between said tubular portions.

2. A unit as recited in claim 1, including seal means for preventing fluid flow between the exterior and interior of said members.

3. A unit as recited in claim 1, including means retaining said members against relative rotation as they are connected together by said connecting means.

4. A unit as recited in claim 1, including insert means removably receivable within the upper end of said second member in a relation lining it to protect said upper end against damage lowering of a cable thereinto.

5. A unit as recited in claim 1, including means operable to clamp tightly against said cable and retain the cable against longitudinal movement relative to said members.

6. The combination of a unit as recited in claim 1 and a mandrel insertable into said members for aligning them while they are being connected together.

7. The combination as recited in claim 6, including means carried by said mandrel for clamping the cable against longitudinal movement.

8. The combination of a unit as recited in claim 1 and a device operable to retain the cable against longitudinal movement while said members are being connected together.

9. A unit to be connected into a drill string which has a cable extending along the outside of the string to the location of said unit and then extending within the interior of the string beyond said unit, comprising:

a first tubular member having threads at an upper end thereof adapted to be connected to an upper portion of the string;

a second tubular member having threads at a lower end thereof adapted to be connected to a lower portion of the string;

said first member having a tubular lower end portion, and said second member having a tubular upper end portion into which said tubular end portion of the first member projects; and a sleeve disposed about said members and having internal threads of different pitch engaging external threads of said two members respectively in a relation to tighten the two members axially together in response to rotation of the sleeve;

said members and said sleeve being shaped to pass a cable from the outside of said first member along a path which first extends radially between said first member and said sleeve and then radially between said tubular end portions of the two members to the inside of said second member.

10. A unit to be connected into a drill string which has a cable extending along the outside of the string to the location of said unit and then extending within the interior of the string beyond said unit, comprising:

a first tubular member having internal first threads at its upper end connectable to an upper portion of the string;

a second tubular member beneath the first member and having external second threads at its lower end adapted to be connected to a lower portion of the string;

said first member having external third threads near its lower end of a first relatively fast pitch and having a tubular end portion therebeneath;

said second member having external fourth threads of relatively slow pitch near its upper end and having a tubular upper end portion into which said tubular lower end portion of the first member projects;

a sleeve disposed about said members and having internal fifth threads of relatively fast pitch engaging said third threads and internal sixth threads of relatively slow pitch engaging said fourth threads in a relation to tighten said first and second members axially together in response to rotation of the sleeve;

said first member having an external groove intersecting said third threads and radially inwardly of said fifth threads and through which said cable extends generally axially at a location radially between said first member and said sleeve;

deformable seal means extending radially between said tubular end portions of said first and second members and preventing fluid flow between the interior and exterior of the members; and key means preventing relative rotation of said first and second members.

11. A unit as recited in claim 10, including clamping elements within said external groove in said first member and engageable with said cable to retain it against longitudinal movement.

12. A unit as recited in claim 11, in which an inner one of said clamping elements is movable axially in said groove and has an outer cable engaging surface inclined to advance inwardly as it advances downwardly, and an outer one of said clamping elements has a correspondingly inclined inner cable engaging surface.

13. A unit as recited in claim 11, in which said seal means include a deformable seal ring between said end portions of the members interrupted at the location of said cable and having end surfaces engageable in sealing relation therewith, and circularly spaced screws carried threadedly by said first member and actuable to apply force axially to said seal ring.

14. The method that comprises:

connecting to the upper end of a drill string a first tubular member of a transfer sub assembly;

lowering a cable into the string through said first tubular member; and then connecting a second tubular member of the sub assembly to said first tubular member with said cable extending between opposed portions of said two tubular members from the interior of the first tubular member to the exterior of the second tubular member for extension to the surface of the earth at the outside of the drill string.

15. The method as recited in claim 14, including forming a fluid-tight seal preventing fluid flow between the interior and exterior of the string at the location of the cable.

16. The method as recited in claim 14, including clamping said cable to one of said members in a relation preventing longitudinal movement of the cable.

17. The method as recited in claim 14, including placing a protective part or parts adjacent the upper end of said first tubular member before lowering of said cable thereinto to protect said upper end against damage by the cable, and removing said protective part or parts after the cable has been lowered through said first tubular member.

18. The method as recited in claim 14, including positioning an aligning mandrel within said tubular members acting to align them relative to one another while said members are being connected together.

19. The method as recited in claim 14, including positioning an aligning and clamping mandrel assembly in said tubular members acting to maintain them in alignment with one another while the two members are being connected together, and clamping said cable against said first tubular member by said aligning and clamping mandrel assembly to prevent longitudinal movement of the cable while said members are connected together.

20. The method as recited in claim 14, including retaining said cable against longitudinal movement as said tubular members are connected together.

21. A unit to be connected into a drill string which has a cable extending along the outside of the string to the location of said unit and then extending within the interior of the string beyond said unit, comprising:

a first tubular member adapted to be connected to a first tubular portion of the string;

a second tubular member adapted to be connected to a second tubular portion of the string; and means for detachably connecting said first and second members together;

said two members having opposed portions which are configured to pass said cable therebetween from the exterior of said first member to the interior of the second member when the members are secured together by said connecting means;

said connecting means including a sleeve disposed about said members and threadedly engaging both of the members in a relation moving the members relatively axially toward one another in response to rotation of the sleeve.

22. A unit to be connected into a drill string which has a cable extending along the outside of the string to the location of said unit and then extending within the interior of the string beyond said unit, comprising:

a first tubular member adapted to be connected to a first tubular portion of the string;

a second tubular member adapted to be connected to a second tubular portion of the string; and means for detachably connecting said first and second members together;

said two members having opposed portions which are configured to pass said cable therebetween from the exterior of said first member to the interior of the second member when the members are secured together by said connecting means;

said connecting means including a sleeve disposed about said members and having internal threads of different pitches engaging external threads of correspondingly different pitches on the two members respectively in a relation actuating the two members relatively axially toward one another in response to rotation of the sleeve.

23. A unit to be connected into a drill string which has a cable extending along the outside of the string to the location of said unit and then extending within the interior of the string beyond said unit, comprising:

a first tubular member adapted to be connected to a first tubular portion of the string;

a second tubular member adapted to be connected to a second tubular portion of the string;

means for detachably connecting said first and second member together;

said two members having opposed portions which are configured to pass said cable therebetween from the exterior of said first member to the interior of the second member when the members are secured together by said connecting means;

said connecting means including a sleeve disposed about said members and threadedly engaging both of the members in a relation moving the members relatively axially toward one another in response to rotation of the sleeve; and clamping means received radially between said sleeve and one of said members for retaining the cable against longitudinal movement.

24. A unit to be connected into a drill string which has a cable extending along the outside of the string to the location of said unit and then extending within the interior of the string beyond said unit, comprising:

a first tubular member adapted to be connected to a first tubular portion of the string;

a second tubular member adapted to be connected to a second tubular portion of the string;

means for detachably connecting said first and second members together;

said two members having opposed portions which are configured to pass said cable therebetween from the exterior of said first member to the interior of the second member when the members are secured together by said connecting means;

said connecting means including a sleeve extending about said members and threadedly engaging both of the members and operable to move the members relatively toward one another in response to rotation of the sleeve; and two clamping elements received radially between said sleeve and one of said members and having opposed surfaces inclined with respect to the axis of said members and acting to tightly clamp the cable therebetween.

25. A unit to be connected into a drill string which has a cable extending along the outside of the string to the location of said unit and then extending within the interior of the string beyond said unit, comprising:

a first tubular member adapted to be connected to a first tubular portion of the string;

a second tubular member adapted to be connected to a second tubular portion of the string;

means for detachably connecting said first and second members together;

said two members having opposed portions which are configured to pass said cable therebetween from the exterior of said first member to the interior of the second member when the members are secured together by said connecting means;

said opposed portions of said two members including tubular end portions of the two members one of which projects into the other and which are constructed to receive a portion of said cable radially between said tubular portions; and deformable seal means received radially between said tubular end portions of said members and adapted to form a seal between said members and with said cable.

26. A unit to be connected into a drill string which has a cable extending along the outside of the string to the location of said unit and then extending within the interior of the string beyond said unit, comprising:

a first tubular member adapted to be connected to a first tubular portion of the string;

a second tubular member adapted to be connected to a second tubular portion of the string;

means for detachably connecting said first and second members together;

said two members having opposed portions which are configurated to pass said cable therebetween from the exterior of said first member to the interior of the second member when the members are secured together by said connecting means;

said opposed portions of said two members including tubular end portions of the two members one of which projects into the other and which are constructed to receive a portion of said cable radially between said tubular portions;

deformable seal means received radially between said tubular end portions of said members and adapted to form a seal between said members and with said cable; and means for applying force axially to said seal means.

27. A unit to be connected into a drill string which has a cable extending along the outside of the string to the location of said unit and then extending within the interior of the string beyond said unit, comprising:

a first tubular member adapted to be connected to a first tubular portion of the string;

a second tubular member adapted to be connected to a second tubular portion of the string;

means for detachably connecting said first and second members together;

said two members having opposed portions which are configured to pass said cable therebetween from the exterior of said first member to the interior of the second member when the members are secured together by said connecting means;

said opposed portions of said two members including tubular end portions of the two members one of which projects into the other and which are constructed to receive a portion of said cable radially between said tubular portions; and a deformable seal ring received radially between said tubular end portions of said members and interrupted at the location of said cable and having ends engageable with the cable in sealing relation.

28. A unit as recited in claim 42, including a force applying ring for exerting force axially against said seal ring, and screws connected threadedly to one of said members and tightenable against said force applying ring.

29. The combination comprising:

a unit to be connected into a drill string which has a cable extending along the outside of the string to the location of said unit and then extending within the interior of the string beyond said unit, said unit including a first tubular member adapted to be connected to a first tubular portion of the string, a second tubular member adapted to be connected to a second tubular portion of the string, and means for detachably connecting said first and second members together, said two members having opposed portions which are configured to pass said cable therebetween from the exterior of said first member to the interior of the second member when the members are secured together by said connecting means;

a mandrel insertible into said members for aligning them while they are being connected together;

a clamping element carried movably by a lower portion of said mandrel and operable by vertical movement to be cammed outwardly in a relation clamping the cable against the inner surface of said second member; and an actuating element extending upwardly through said mandrel for moving said clamping element vertically.

30. A unit to be connected into a drill string which has a cable extending along the outside of the string to the location of said unit and then extending within the interior of the string beyond said unit, comprising:

a first tubular member adapted to be connected to a first tubular portion of the string;

a second tubular member adapted to be connected to a second tubular portion of the string; and means for detachably connecting said first and second members together;

said two members having opposed portions which are configured to pass said cable therebetween from the exterior of said first member to the interior of the second member when the members are secured together by said connecting means;

said connecting means including a sleeve disposed about said members and having internal threads of different pitches engaging external threads of correspondingly different pitches on the two members respectively in a relation actuating the members relatively axially toward one another in response to rotation of the sleeve;

one of said internal threads of said sleeve having a minor diameter at least as great as the major diameter of the differently pitched external thread of one of said members and being movable to a position thereabout.

* * * * *